US007994696B2

(12) United States Patent
Park et al.

(10) Patent No.: US 7,994,696 B2
(45) Date of Patent: Aug. 9, 2011

(54) ELECTRON EMISSION DEVICE, ELECTRON EMISSION TYPE BACKLIGHT UNIT INCLUDING THE ELECTRON EMISSION DEVICE, AND METHOD OF MANUFACTURING THE ELECTRON EMISSION DEVICE

(75) Inventors: Hyun-Ki Park, Suwon-si (KR); Hee-Sung Moon, Suwon-si (KR); Yoon-Jin Kim, Suwon-si (KR); Jae-Myung Kim, Suwon-si (KR); Kyu-Nam Joo, Suwon-si (KR); So-Ra Lee, Suwon-si (KR)

(73) Assignee: Samsung SDI Co., Ltd., Suwon-Si, Gyeonggi-do (KR)

( * ) Notice: Subject to any disclaimer, the term of this patent is extended or adjusted under 35 U.S.C. 154(b) by 483 days.

(21) Appl. No.: 12/155,722

(22) Filed: Jun. 9, 2008

(65) Prior Publication Data

US 2009/0072705 A1 Mar. 19, 2009

(30) Foreign Application Priority Data

Sep. 13, 2007 (KR) ..... 10-2007-0093235

(51) Int. Cl.
*H01J 17/49* (2006.01)

(52) U.S. Cl. ..... 313/495; 313/497; 445/25

(58) Field of Classification Search ..... 313/495–497; 445/24–25

See application file for complete search history.

(56) References Cited

U.S. PATENT DOCUMENTS

| | | | | |
|---|---|---|---|---|
| 2005/0275336 | A1* | 12/2005 | Wei et al. | 313/495 |
| 2007/0035231 | A1* | 2/2007 | Song et al. | 313/496 |
| 2007/0164648 | A1* | 7/2007 | Jiang et al. | 313/310 |

FOREIGN PATENT DOCUMENTS

| | | | |
|---|---|---|---|
| JP | 2000-251620 | A | 9/2000 |
| KR | 10-2004-0073746 | A | 8/2004 |
| KR | 10-2006-0114865 | A | 11/2006 |
| KR | 10-2007-0018509 | A | 2/2007 |

* cited by examiner

*Primary Examiner* — Anne M Hines
(74) *Attorney, Agent, or Firm* — Lee & Morse, P.C.

(57) ABSTRACT

An electron emission device includes a base substrate, at least one isolation layer on the base substrate, the isolation layer having a first lateral side and a second lateral side opposite the first lateral side, first and second electrodes on the base substrate along the first and second lateral sides of the isolation layer, respectively, a first electron emission layer between the first electrode and the first lateral side of the isolation layer, and a second electron emission layer between the second electrode and the second lateral side of the isolation layer.

19 Claims, 4 Drawing Sheets

ELECTRON EMISSION DEVICE, ELECTRON EMISSION TYPE BACKLIGHT UNIT INCLUDING THE ELECTRON EMISSION DEVICE, AND METHOD OF MANUFACTURING THE ELECTRON EMISSION DEVICE

BACKGROUND OF THE INVENTION

1. Field of the Invention

Embodiments of the present invention relate to an electron emission device, an electron emission type backlight unit including the same, and a method of manufacturing the same. More particularly, embodiments of the present invention relate to an electron emission device having an electrode structure capable of preventing an inter-electrode short, an electron emission type backlight unit including the electron emission device, and a method of manufacturing the same.

2. Description of the Related Art

Generally, electron emission devices may be classified into devices using a hot cathode as an electron emission source and devices using a cold cathode as an electron emission source. Examples of electron emission devices using cold cathodes as electron emission sources may include a Field Emission Device (FED), a Surface Conduction Emitter (SCE), a Metal Insulator Metal (MIM) device, a Metal Insulator Semiconductor (MIS) device, a Ballistic electron Surface Emitting (BSE) device, and so forth.

FEDs may include a material having a low work function or a high beta function as an electron emission source between electrodes, so application of voltage to the electrodes may cause electron emission in a vacuum due to an electric field difference. SCEs may include a conductive thin film with micro-cracks as an electron emission source between electrodes, so application of voltage to the electrodes may cause electrode emission from the micro-cracks when a current flows on a surface of the conductive thin. MIM/MIS devices may have a metal-dielectric layer-metal/semiconductor structures, respectively, so application of voltage to two metals having the dielectric layer therebetween or to a metal and a semiconductor having the dielectric layer therebetween may cause electron emissions from a high electron potential to a metal having a low electron potential. BSE devices may have a structure of an insulating layer between a metal and an electron supply layer, i.e., a metal layer or a semiconductor layer on an ohmic electrode, so application of voltage to the metal layer and the electron supply layer may cause electron emission due to a smaller size of the semiconductor than a mean-free-path of electrons therein, i.e., electron travelling without scattering.

A conventional electron emission device may include electrodes on a substrate and electron emission layers coated on the electrodes. An anode and a phosphor layer may be positioned to face the electrodes. Application of voltage to the plurality of electrodes may form an electric field therebetween, so electrons may be emitted from the electron emission layers. Application of voltage to the anode may accelerate the emitted electrons toward the anode to excite the phosphor layer.

The conventional electron emission device may have several structural problems. Firstly, distances between the electrodes on the substrate may be hard to adjust. In particular, if a distance between the electrodes is too small, an electrical short may be caused. If a distance between the electrodes is too large, electron emission may not be efficient. Further, it may be difficult to maintain a uniform distance between the electron emission layers on the electrodes.

Secondly, the electric field between the anode and electrodes may be stronger than the electric field between the electrodes on the substrate, so a diode emission may be caused, i.e., false emission of electrons to collide with unintended regions of the phosphor layer. The diode emission may cause unwanted light emission, i.e., incorrect pixel illumination. Accordingly, image quality may be reduced and power and light emitting efficiency of the electron emission device may be decreased. Attempts have been made to prevent diode emission by limiting voltage level applied to the anode, but a reduced voltage on the anode may reduce current density, so image brightness may be decreased. Attempts have been made to increase current density by increasing an amount of emitted electrons from the electron emission layers, but increased electron emission may reduce lifetime of the electron emission layers, so overall life time of the electron emission device may be decreased.

SUMMARY OF THE INVENTION

Embodiments of the present invention are therefore directed to an electron emission device, an electron emission type backlight unit including the same, and a method of manufacturing the same, which substantially overcome one or more of the disadvantages of the related art.

It is therefore a feature of embodiments of the present invention to provide an electron emission device having an electrode structure capable of preventing an inter-electrode short.

It is another feature of embodiments of the present invention to provide an electron emission device that can be easily manufactured.

It is yet another feature of embodiments of the present invention to provide an electron emission type backlight unit including an electron emission device with one or more of the above features.

It is still another feature of embodiments of the present invention to provide a method of manufacturing an electron emission device with one or more of the above features.

At least one of the above and other features and advantages of the present invention may be realized by providing an electron emission device, including a base substrate, at least one isolation layer on the base substrate, the isolation layer having a first lateral side and a second lateral side opposite the first lateral side, first and second electrodes on the base substrate along the first and second lateral sides of the isolation layer, respectively, a first electron emission layer between the first electrode and the first lateral side of the isolation layer, and a second electron emission layer between the second electrode and the second lateral side of the isolation layer.

The isolation layer may include one or more of $SiO_x$, $CrO_x$, and/or $CuCrO_x$. A thickness of the isolation layer may be about 0.1 μm to about 5 μm. The electron emission device may further include an insulating layer between the base substrate and at least one of the first electrode and the second electrode. The electron emission device may further include a first insulating layer between the first electrode and the base substrate and a second insulating layer between the second electrode and the base substrate. The insulating layer may include a frit.

The first electron emission layer may be on the first electrode, and the second electron emission layer may be on the second electrode. The first electron emission layer may be only on a lateral side of the first electrode, and the second electron emission layer may be only on a lateral side of the second electrode. Each of the first and second electron emission layers may be entirely between the first and second electrodes. The isolation layer may be between the first and second electron emission layers and in direct contact with both the first and second electron emission layers. The isolation layer may completely fill a gap between the first and second electron emission layers. The isolation layer may be continuous along a direction parallel to a direction of the first and second emission layers.

At least one of the above and other features and advantages of the present invention may be also realized by providing an electron emission type backlight unit, including an anode on a front substrate, a phosphor layer on the front substrate, and an electron emission device facing the anode and the phosphor, the electron emission device including, a base substrate, at least one isolation layer on the base substrate, the isolation layer having a first lateral side and a second lateral side opposite the first lateral side, first and second electrodes on the base substrate along the first and second lateral sides of the isolation layer, respectively, a first electron emission layer between the first electrode and the first lateral side of the isolation layer, the first electron emission layer facing the phosphor layer, and a second electron emission layer between the second electrode and the second lateral side of the isolation layer, the second electron emission layer facing the phosphor layer.

At least one of the above and other features and advantages of the present invention may be also realized by providing a method of manufacturing an electron emission device, including forming a first electrode and a second electrode on a base substrate, forming an isolation layer on the base substrate between the first electrode and the second electrode, such that the first and second electrodes extend along first and second lateral sides of the isolation layer, respectively, forming a first electron emission layer between the first electrode and the first lateral side of the isolation layer, and forming a second electron emission layer between the second electrode and the second lateral side of the isolation layer. The first and second electron emission layers may be formed to be electrically connected to the first electrode or the second electrode.

Forming the isolation layer may include patterning an isolation layer material covering the base substrate, the first electrode, and the second electrode. Forming the first and second electron emission layers may include patterning an electron emission layer material covering the base substrate, the first electrode, the second electrode, and the isolation layer. Forming the first and second electron emission layers may include performing an exposure process by partially curing the electron emission layer material using the first electrode, the second electrode, and the isolation layer as masks, and performing a developing process by removing an uncured portion of the electron emission layer material using a developer. Forming the first and second electron emission layers may include performing a back exposure process.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
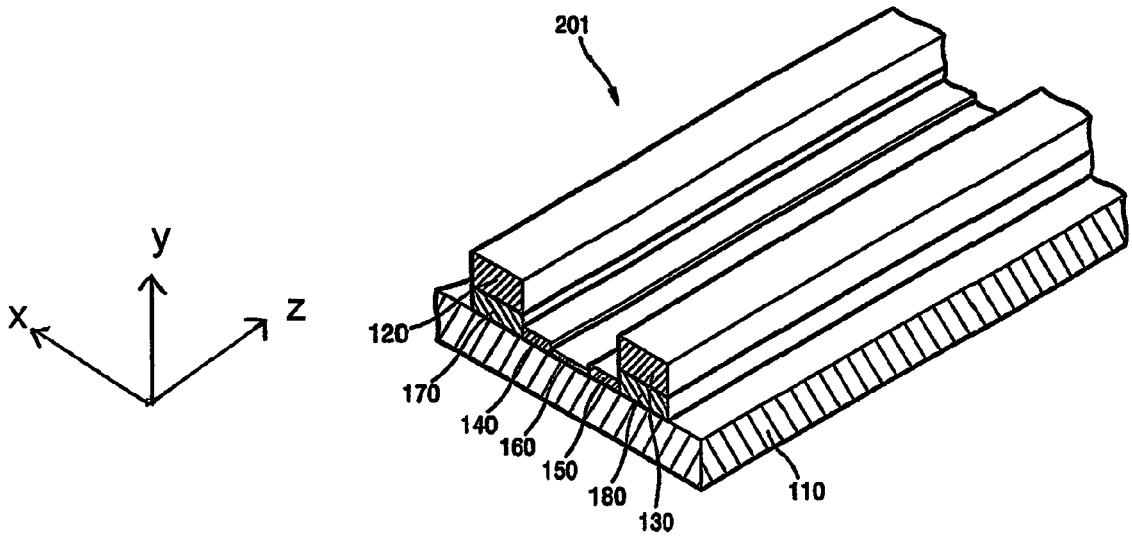
FIG. 1 illustrates a partial, perspective view of an electron emission device according to an embodiment of the present invention.

Korean Patent Application No. 10-2007-0093235, filed on Sep. 13, 2007, in the Korean Intellectual Property Office, and entitled: "Electron Emission Device, Electron Emission Type Backlight Unit Including the Electron Emission Device, and Method of Manufacturing the Electron Emission Device," is incorporated by reference herein in its entirety.

Exemplary embodiments of the present invention will now be described more fully hereinafter with reference to the accompanying drawings, in which exemplary embodiments of the invention are illustrated. Aspects of the invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of elements and regions may be exaggerated for clarity of illustration. It will also be understood that when an element is referred to as being "on" another element or substrate, it can be directly on the other element or substrate, or intervening elements may also be present. Further, it will be understood that the term "on" can indicate solely a vertical arrangement of one element with respect to another element, and may not indicate a vertical orientation, e.g., a horizontal orientation. In addition, it will also be understood that when an element is referred to as being "between" two elements, it can be the only element between the two elements, or one or more intervening elements may also be present. Like reference numerals refer to like elements throughout.

As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. Further, these expressions are open-ended, unless expressly designated to the contrary by their combination with the term "consisting of." For example, the expression "at least one of A, B, and C" may also include an nth member, where n is greater than 3, whereas the expression "at least one selected from the group consisting of A, B, and C" does not.

FIG. 1 illustrates a schematic, partially cut-away perspective view of an electron emission device according to an embodiment of the present invention. Referring to FIG. 1, an electron emission device 201 may include a base substrate 110, at least one first electrode 120, at least one second electrode 130, at least one first electron emission layer 140, at least one second electron emission layer 150, and at least one isolation layer 160. The electron emission device 201 may further include first and second insulating layers 170 and 180.

The base substrate 110 may be a plate member having a predetermined thickness, and may be formed of any suitable material. Examples of suitable materials may include one or more of a quartz glass, a glass containing a predetermined amount of impurity, e.g., sodium (Na), a plate glass, a glass substrate coated with a silicon oxide or an aluminum oxide, and/or a ceramic material. In order to realize a flexible display apparatus, the base substrate 110 may be formed of a flexible material.

A plurality of the first and second electrodes 120 and 130 may extend along a first direction, e.g., along the z-axis, on the base substrate 110, and may be parallel to each other e.g., arranged in a stripe pattern. The first and second electrodes 120 and 130 may be spaced apart from each other along a second direction, e.g., along the x-axis, and may be alternately arranged along the second direction, e.g., one first electrode 120 may be between two second electrodes 130. A distance between one first electrode 120 and an adjacent second electrode 130 along the second direction, i.e., as measured along the x-axis between two facing sidewalls of the first and second electrodes 120 and 130, may be about 1 μm to about 20 μm. When the distance between the first electrode 120 and the second electrode 130 is sufficiently large, an inter-electrode short may be prevented or substantially minimized.

The first electrode 120 and the second electrode 130 may be formed of an electrically conductive material. For example, the first electrode 120 and the second electrode 130 may be formed of a metal, e.g., Al, Ti, Cr, Ni, Au, Ag, Mo, W, Pt, Cu, Pd, Pd—Ag, or an alloy thereof, a printed conductor including metal oxide and glass, e.g., $RuO_2$, a transparent conductor, e.g., one or more of ITO, $In_2O_3$, and/or $SnO_2$, a semiconductor material, e.g., polysilicon, and so forth. The roles of the first and second electrodes 120 and 130 may be performed in turn, thereby increasing the lifetime of the electron emission device 201 by about two fold or more.

The first and second electron emission layers 140 and 150 may be respectively disposed on the base substrate 110 along inner lateral sides of the first electrode 120 and the second electrode 130, i.e., along facing surfaces of the first electrode 120 and the second electrode 130 that may be perpendicular to the base substrate 110. For example, as illustrated in FIG. 1, the first electron emission layer 140 may extend in the first direction, e.g., the z-axis, along an inner sidewall of the first electrode 120 and the second electron emission layer 150 may extend in the first direction, e.g., the z-axis, along an inner sidewall of the second electrode 130. Accordingly, both the first and second electrodes 140 and 150 may be entirely between the first and second electrodes 120 and 130. The first and second electron emission layers 140 and 150 may be on respective inner lateral sides of the first and second electrodes 120 and 130, e.g., in direct contact with the respective lateral sides of the first and second electrodes 120 and 130. The first and second electron emission layers 140 and 150 may be electrically connected to the first electrode 120 and/or the second electrode 130.

The first and second electron emission layers 140 and 150 may include an electron emission material having a low work function and a high beta function, e.g., carbon nanotubes (CNT), a carbonaceous material, such as graphite, diamond, or diamond-like carbon, a nano material, such as nanotube, nanowire, or nanorod, a carbide-derived carbon, and so forth. For example, the CNT may exhibit good electron emission characteristics, i.e., enabling a low voltage operation, so an apparatus using a CNT as an electron emission source may be easily manufactured on a large scale.

The isolation layer 160 may be disposed between the first and second electron emission layers 140 and 150. More specifically, the isolation layer 160 may be formed on the base substrate 110, and may extend along the first direction, e.g., the z-axis, between the first and second electron emission layers 140 and 150. For example, the isolation layer 160 may be in direct contact with both the first and second electron emission layers 140 and 150. For example, the isolation layer 60 may be continuous along the z-axis. A gap between the first and second electron emission layers 140 and 150, e.g., an emission gap, may be completely filled with the isolation layer 160. Each of the first and second electron emission layers 140 and 150 may be between the isolation layer 160 and the first and second electrodes 120 and 130, respectively.

The isolation layer 160 may be formed of any suitable insulating material or of any suitable resistive material. For example, the isolation layer 160 may be formed of a carbonaceous material, e.g., graphite, a metal oxide, e.g., chromium oxide, or an insulating material, e.g., $SiO_x$, $SiN_x$, an insulating black material, and so forth. Examples of a chromium oxide may include one or more of $CrO_2$, $Cr_2O_3$, $Cr_3O_4$, and/or $CuCrO_x$. Examples of an insulating black material may include $RuO_2$.

A thickness of the isolation layer 160 along a third direction, e.g., the y-axis, may be lower than thicknesses of the first and second electron emission layers 140 and 150 and/or lower than thicknesses of the first and second electrodes 120 and 130. For example, the thickness of the isolation layer 160 may be from about 0.1 μm to about 5 μm. A width of the isolation layer 160 along the second direction, e.g., along the x-axis, may be smaller than the distance between the first electrode 120 and the second electrode 130. For example, the width of the isolation layer 160 may be from about 1 μm to about 12 μm.

Formation of the isolation layer 160 between the first and second electrodes 120 and 130 may provide sufficient minimal distance between the first electrode 120 and the second electrode 130, thereby preventing a short therebetween. Moreover, formation of the first electrode 120 and the second electrode 130 along sides of the isolation layer 160 may prevent an excessive distance between the first electrode 120 and the second electrode 130, thereby facilitating electron emission. In addition, forming the first and second electron emission layers 140 and 150 along opposing lateral sides of the isolation layer 160, may provide a uniform distance between the first and second electron emission layers 140 and 150, so electron emission may be facilitated and a diode emission may be prevented or substantially minimized.

The first insulating layer 170 and/or the second insulating layer 180 may be disposed between the base substrate 110 and the first electrode 120 and/or between the base substrate 110 and the second electrode 130, respectively. The first insulating layer 170 may insulate the base substrate 110 from the first electrode 120, and the second insulating layer 180 may insulate the base substrate 110 from the second electrode 130. For example, widths of the first and second insulating layers 170 and 180 along the second direction, e.g., the x-axis, may substantially equal widths of the first and second electrodes 120 and 130, respectively. The first and second insulating layers 170 and 180 may be formed of any suitable insulating material, e.g., silicon oxide, silicon nitride, frit, and so forth. Examples of the frit may include, but are not limited to, PbO—$SiO_2$-based frit, PbO—$B_2O_3$—$SiO_2$-based frit, ZnO—$SiO_2$-based frit, ZnO—$B_2O_3$—$SiO_2$-based frit, $Bi_2O_3$—$SiO_2$-based frit, and $Bi_2O_3$—$B_2O_3$—$SiO_2$-based frit.

If the first and second insulating layers 170 and 180 are used in the electron emission device 201, as illustrated in FIG. 1, the first electrode 120 and the second electrode 130 may be arranged on upper surfaces of the first and second insulating layers 170 and 180, respectively. The first and second electron emission layers 140 and 150 may be arranged directly on the base substrate 110 along side walls of the first and second insulating layers 170 and 180, respectively. Accordingly, first and second electron emission layers 140 and 150 may not be in direct contact with the first and second electrodes 120 and 130, respectively, as illustrated in FIG. 1.

When the electron emission device 201 includes the first and second insulating layers 170 and 180, the first and second electrodes 120 and 130 may be positioned at a higher vertical position, i.e., a longer distance along the y-axis as measured from an upper surface of the base substrate 110, relatively to the first and second electrons emission layers 140 and 150. Therefore, electron emission efficiency and electron emission amount from the first and second electron emission layers 140 and 150 may be enhanced. It is noted, however, that if sufficiently high electron emission efficiency is guaranteed by forming the first electrode 120 and the second electrode 130 directly on the base substrate 110 to a sufficient height, the first and second insulating layers 170 and 180 may be omitted.

Figure 2:
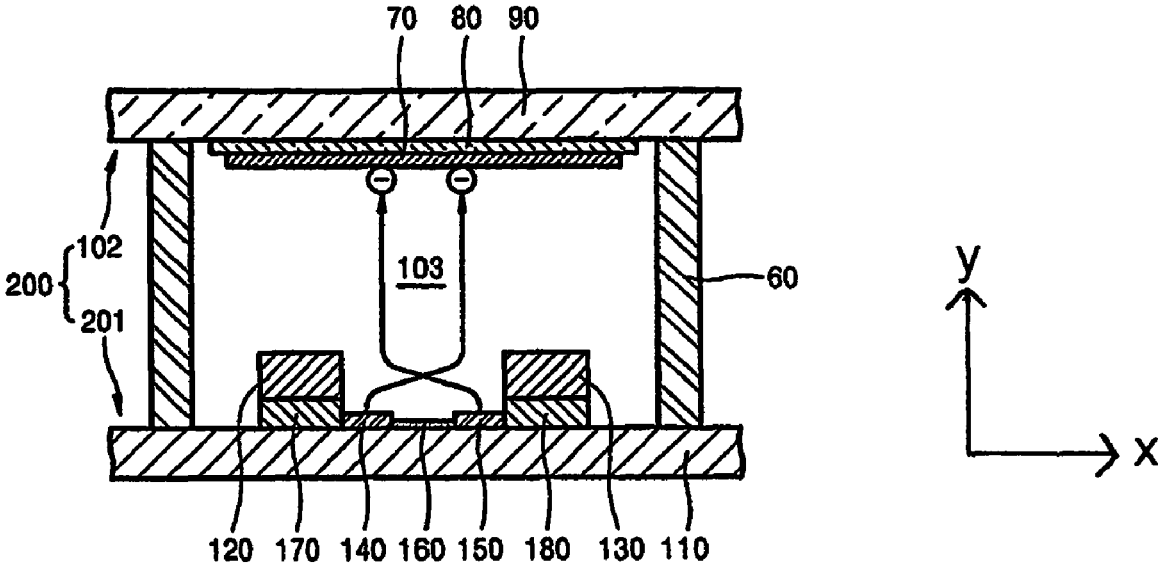
FIG. 2 illustrates a partial, cross-sectional view of an electron emission type backlight unit including the electron emission device in FIG. 1.

FIG. 2 illustrates a schematic view of an electron emission type backlight unit including the electron emission device in FIG. 1. Referring to FIG. 2, an electron emission type backlight unit 200 may include the electron emission device 201 and a front panel 102.

The front panel 102 may be disposed to face the electron emission device 201, and may be spaced apart therefrom. The front panel 102 may include a front substrate 90, a phosphor layer 70 on the front substrate 90, and an anode 80 on the front substrate 90. The front panel 102 and the electron emission device 201 may be arranged so the anode electrode 80 and the first and second electrodes 120 and 130 may be between the front and base substrates 90 and 110.

The front substrate 90 may be transparent to visible light, and may be formed of a substantially same material as the base substrate 110. The anode 80 may be formed of a substantially same material as the first and second electrodes 120 and 130, and may accelerate electrons emitted from the electron emission device 201 toward the front substrate 90. The phosphor layer 70 may be formed on the anode 80, i.e., the anode 80 may be between the front substrate 90 and the phosphor layer 70, so electrons accelerated from the electron emission device 201 toward the front substrate 90 may collide with the phosphor layer 70. Electrons colliding with the phosphor layer 70 may excite the phosphor layer 70 to emit visible light. The phosphor layer 70 may be formed of a cathode luminescence (CL) type phosphor. Examples of the phosphor in the phosphor layer 70 may include one or more of a red-emitting phosphor, e.g., one or more of $SrTiO_3$:Pr, $Y_2O_3$:Eu, and/or $Y_2O_3S$:Eu, a green-emitting phosphor, e.g., one or more of $Zn(Ga, Al)_2O_4$:Mn, $Y_3(Al, Ga)_5O_{12}$:Tb, $Y_2SiO_5$:Tb, and/or one or more of ZnS:Cu,Al, and/or a blue-emitting phosphor, e.g., $Y_2SiO_5$:Ce, $ZnGa_2O_4$, and/or ZnS:Ag,Cl.

In order to normally operate the electron emission type backlight unit 200, the front panel 102 and the electron emission device 201 may be attached, so a vacuum space 103, i.e., a space having a vacuum pressure lower than an atmospheric pressure, may be defined therebetween. Accordingly, electron emission may be performed in a vacuum state. In order to support the vacuum space 103, spacers 60 may be disposed between the front panel 102 and the electron emission device 201 at predetermined positions. The spacers 60 may maintain a constant distance between the phosphor layer 70 and the electron emission device 201. A glass frit (not shown) may be used to seal the vacuum space 103 between the front panel 102 and the electron emission device 201. For example, the glass frit may be applied around the vacuum space 103 to seal the vacuum space.

The electron emission type backlight unit 200 may be operated as follows. A negative (−) voltage and a positive (+) voltage may be respectively applied to the first electrode 120 and the second electrode 130 of the electron emission device 201 to generate an electric field therebetween. As illustrated in FIG. 2, the electric field between the first and second electrodes 120 and 130 may trigger electron emission from the first and second electron emission layers 140 and 150 toward the second and first electrodes 130 and 120, respectively. When a positive (+) voltage much higher than the positive (+) voltage applied to the second electrode 130 is applied to the anode 80, electrons emitted from the first and second electron emission layers 140 and 150 may be accelerated toward the anode 80. The accelerating electrons may excite the phosphor layer 70 to emit visible light. It is noted that a negative (−) voltage is not necessarily applied to the first electrode 120, as long as an appropriate electric potential necessary for electron emission is formed between the first electrode 120 and the second electrode 130. The emission of the electrons may be controlled by the voltage applied to the second electrode 130.

The electron emission type backlight unit 200 illustrated in FIG. 2 may be a surface light source, and may be used as a backlight unit of a non-emissive display device, e.g., TFT-LCD. Further, in order to display images instead of simply emitting a visible ray from a surface light source or in order to use a backlight unit having a dimming function, the first electrode 120 and the second electrode 130 of the electron emission device 201 may be alternately arranged. For this, one of the first electrode 120 and the second electrode 130 may include a main electrode part and a branch electrode part. For example, the first electrode 120 may include main electrode part alternatively arranged with the second electrode 130, and the branch electrode part in the first electrode 120 may protrude from the main electrode part to face the second electrode 130. The first and second electron emission layers 140 and 150 may be formed on the branch electrode part or on a part facing the branch electrode part.

Hereinafter, a method of manufacturing the electron emission device according to an embodiment of the present invention will be described with reference to FIGS. 3-8. FIGS. 3-8 illustrate sequential sectional views of stages in a method of manufacturing an electron emission device according to an embodiment of the present invention.

Figure 3:
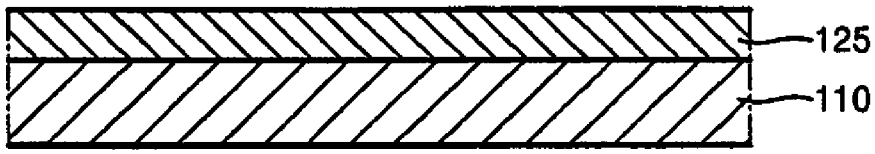
FIGS. 3-8 illustrate cross-sectional views of sequential stages in a method of manufacturing an electron emission device according to an embodiment of the present invention.
Figure 4:
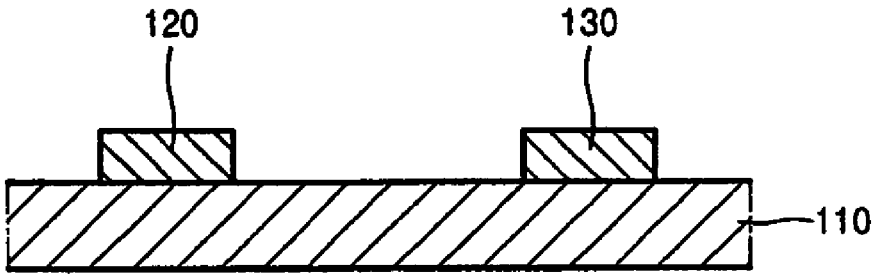

First, referring to FIG. 3, an electrode material 125 may be stacked, e.g., by a deposition method, on the base substrate 110. Next, referring to FIG. 4, the electrode material 125 may be patterned to form the first electrode 120 and the second electrode 130.

Figure 5:
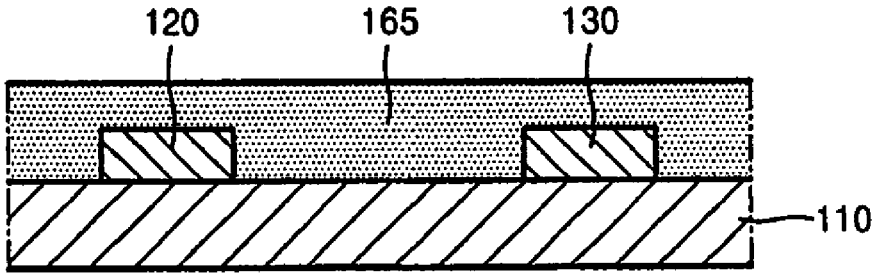
Figure 6:
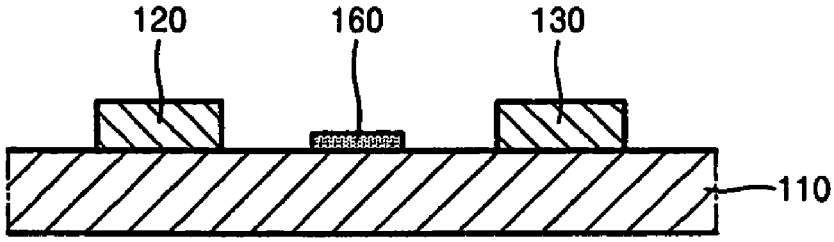

Next, referring to FIG. 5, an isolation layer material 165 may be stacked to cover the base substrate 110 and the first and second electrodes 120 and 130. The isolation layer material 165, as illustrated in FIG. 6, may be patterned to form the isolation layer 160 between the first and second electrodes 120 and 130. In particular, the isolation layer 160 may be formed in an approximately middle position between the first electrode 120 and the second electrode 130, so a distance along the x-axis between the isolation layer 160 and the first electrode 120 may substantially equal a distance along the x-axis between the isolation layer 160 and the second electrode 130.

Figure 7:
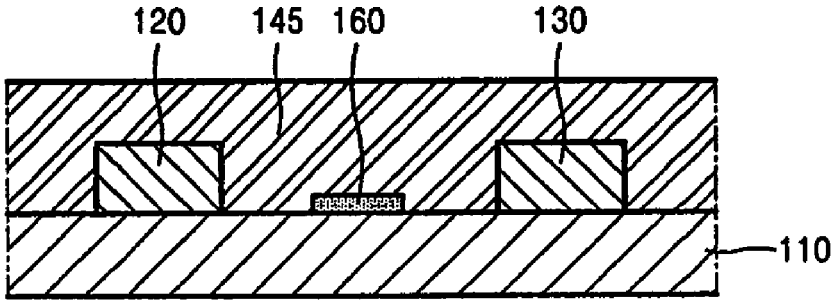
Figure 8:
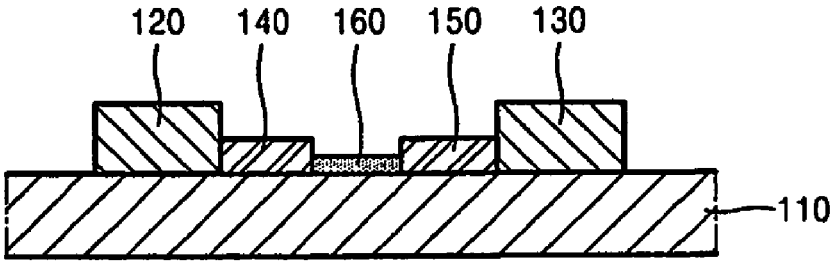

Next, referring to FIG. 7, an electron emission layer material 145 may be stacked to cover the base substrate 110, the first and second electrodes 120 and 130, and the isolation layer 160. Accordingly, spaces between the isolation layer 160 and first and second electrodes 120 and 130 may be completely filled with the electron emission material 145. Referring to FIG. 9, the electron emission layer material 145 may be patterned to form the first and second electron emission layers 140 and 150 between the first electrode layer 120 and the isolation layer 160 and between the second electrode 130 and the isolation layer 160, respectively. Widths of the first and second emission layers 140 and 150 along the x-axis may substantially equal distances between the first electrode 120 and the isolation layer 160 and the second electrode 130 and the isolation layer 160, respectively. In other words, each of the first and second electron emission layers 140 and 150 may be in direct contact with the isolation layer 160 and the first and second electrode 120 and 130, respectively.

The electron emission layer material 145 may be patterned by a front light exposure process or a back light exposure process. For example, electron emission layer material 145 may be partially cured using the first electrode 120, the second electrode 130, and the isolation layer 160 as masks, and developing the partially cured material to remove an uncured portion of the electron emission layer material 145 using a developer. In other words, when the electron emission layer material 145 is processed via the back light exposure process, the first electrode 120, the second electrode 130, and the isolation layer 160 may function as masks. Thus, a separate mask process may not be required, thereby simplifying the manufacture process of the electron emission device and reducing the manufacturing costs.

An electron emission device according to embodiments of the present invention may be advantageous in providing an electrode structure capable of preventing a short. Further, the electron emission device may be easily manufactured by a simplified process, thereby reducing manufacturing time and costs.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device, comprising:

a base substrate;

at least one isolation layer on the base substrate, the isolation layer having a first lateral side and a second lateral side opposite the first lateral side;

first and second electrodes on the base substrate along the first and second lateral sides of the isolation layer, respectively, wherein the first and second electrodes are adjacent electrodes of the electron emission device;

a first electron emission layer between the first electrode and the first lateral side of the isolation layer; and a second electron emission layer between the second electrode and the second lateral side of the isolation layer.

2. The electron emission device as claimed in claim 1, wherein the isolation layer includes one or more of $SiO_x$, $CrO_x$, and/or $CuCrO_x$.

3. The electron emission device as claimed in claim 1, wherein a thickness of the isolation layer is about 0.1 μm to about 5 μm.

4. The electron emission device as claimed in claim 1, further comprising an insulating layer between the base substrate and at least one of the first electrode and the second electrode.

5. The electron emission device as claimed in claim 4, further comprising a first insulating layer between the first electrode and the base substrate and a second insulating layer between the second electrode and the base substrate.

6. The electron emission device as claimed in claim 4, wherein the insulating layer includes a frit.

7. The electron emission device as claimed in claim 1, wherein the first electron emission layer is on the first electrode and the second electron emission layer is on the second electrode.

8. The electron emission device as claimed in claim 7, wherein the first electron emission layer is only on a lateral side of the first electrode and the second electron emission layer is only on a lateral side of the second electrode.

9. The electron emission device as claimed in claim 1, wherein each of the first and second electron emission layers is entirely between the first and second electrodes.

10. The electron emission device as claimed in claim 1, wherein the isolation layer is between the first and second electron emission layers and in direct contact with both the first and second electron emission layers.

11. The electron emission device as claimed in claim 10, wherein the isolation layer completely fills a gap between the first and second electron emission layers.

12. The electron emission device as claimed in claim 1, wherein the isolation layer is continuous along a direction parallel to a direction of the first and second emission layers.

13. An electron emission type backlight unit, comprising:

an anode on a front substrate;

a phosphor layer on the front substrate; and an electron emission device facing the anode and the phosphor, the electron emission device including, a base substrate;

at least one isolation layer on the base substrate, the isolation layer having a first lateral side and a second lateral side opposite the first lateral side;

first and second electrodes on the base substrate along the first and second lateral sides of the isolation layer, respectively, wherein the first and second electrodes are adjacent electrodes of the electron emission device;

a first electron emission layer between the first electrode and the first lateral side of the isolation layer, the first electron emission layer facing the phosphor layer; and a second electron emission layer between the second electrode and the second lateral side of the isolation layer, the second electron emission layer facing the phosphor layer.

14. A method of manufacturing an electron emission device, comprising:

forming a first electrode and a second electrode adjacent to each other on a base substrate;

forming an isolation layer on the base substrate between the first electrode and the second electrode, such that the first and second electrodes extend along first and second lateral sides of the isolation layer, respectively;

forming a first electron emission layer between the first electrode and the first lateral side of the isolation layer; and forming a second electron emission layer between the second electrode and the second lateral side of the isolation layer.

15. The method as claimed in claim 14, wherein the first and second electron emission layers are formed to be respectively electrically connected to the first electrode and the second electrode.

16. The method as claimed in claim 14, wherein forming the isolation layer includes patterning an isolation layer material covering the base substrate, the first electrode, and the second electrode.

17. The method as claimed in claim 14, wherein forming the first and second electron emission layers includes patterning an electron emission layer material covering the base substrate, the first electrode, the second electrode, and the isolation layer.

18. The method as claimed in claim 17, wherein forming the first and second electron emission layers includes, performing an exposure process by partially curing the electron emission layer material using the first electrode, the second electrode, and the isolation layer as masks; and performing a developing process by removing an uncured portion of the electron emission layer material using a developer.

19. The method as claimed in claim 14, wherein forming the first and second electron emission layers includes performing a back exposure process.

* * * * *